United States Patent [19]

Wetzel

[11] Patent Number: 4,951,980

[45] Date of Patent: Aug. 28, 1990

[54] CABINET LATCH ASSEMBLY WITH ELECTRICAL GROUNDING FEATURE

[75] Inventor: Manfred Wetzel, Dietzholztal-Ewersbach, Fed. Rep. of Germany

[73] Assignee: Rittal-Werk Rudolf Loh GmbH & Co. KG, Dietzholztal-Ewersbach, Fed. Rep. of Germany

[21] Appl. No.: 339,404

[22] Filed: Apr. 18, 1989

[30] Foreign Application Priority Data

Apr. 19, 1988 [DE] Fed. Rep. of Germany ..... 3812972

[51] Int. Cl.[5] ..... F05C 3/00

[52] U.S. Cl. ..... 292/202; 292/DIG. 53; 292/DIG. 64; 174/51; 174/78; 437/108; 437/565; 70/451

[58] Field of Search ..... 248/27.1, 27.3; 439/92, 439/108, 56 S; 70/370, 371, 451, 466; 411/173, 176, 180, 181; 174/35 GC, 51, 78, 35 C; 292/DIG. 64, 202, DIG. 53, 67, 247, 336.3, 200, 350

[56] References Cited

U.S. PATENT DOCUMENTS

| | | | |
|---|---|---|---|
| 2,911,608 | 11/1959 | Lee | 174/35 GC X |
| 3,247,312 | 4/1966 | Alessi | 174/35 GC |
| 3,486,158 | 12/1969 | Soltysik et al. | 439/92 |
| 3,503,233 | 3/1970 | Russell et al. | 70/451 X |
| 3,929,360 | 12/1975 | Gulistan | 292/67 |
| 4,099,397 | 7/1978 | Davenbaugh | 70/451 X |
| 4,186,952 | 2/1980 | Glass | 292/DIG. 53 X |
| 4,270,780 | 6/1981 | Bernard | 292/DIG. 64 X |
| 4,310,133 | 1/1982 | Wetterhorn et al. | 248/27.1 |
| 4,496,791 | 1/1985 | Reichert et al. | 174/51 |
| 4,533,165 | 8/1985 | Edelman | 292/247 X |

*Primary Examiner*—Eric K. Nicholson

[57] ABSTRACT

A latch assembly includes a housing for inserting through an opening or breach in a door panel and secured to the panel by a retaining cage. In the preferred embodiment, the housing and the breach will have the same cross-sectional square shape. A retaining cage includes a retainer plate and a plurality of supporting legs and substantially surrounds the housing when the assembly is mounted on a door panel. At each cornering edge of the housing, a depression is formed for receiving a retainer extension formed at the end of each supporting leg. Each supporting leg also includes a support claw or tip which, in the mounted position, engages a surface of the door panel and pierces any non-conductive coating thereon so that the rotary bar handle and the other parts of the assembly may be electrically grounded. The cooperative configuration of the housing and the retaining cage permits mounting of the assembly in one of four positions. The invention is especially useful in constructing cabinets for electrical equipment where such cabinets must be electrically grounded.

20 Claims, 1 Drawing Sheet

CABINET LATCH ASSEMBLY WITH ELECTRICAL GROUNDING FEATURE

FIELD OF THE INVENTION

This invention is related generally to cabinet latch assemblies and, more particularly, to a cabinet latch assembly which incorporates an electrical grounding feature and which has provisions for mounting the assembly and components thereof in any one of several positions.

BACKGROUND OF THE INVENTION

Industrial sheet metal cabinets often have doors which are maintained in closed position by a latch assembly mounted on the moveable door and arranged to engage a lip on the stationary cabinet frame. When such cabinets are used to house electrical equipment, it is often highly desirable or required from a safety standpoint that all parts of the cabinet, including the latch assembly and the handle grasped by the user, be electrically grounded. Additionally, cabinets including but not limited to those made of sheet metal are made in a wide variety of sizes and door configurations and it is highly desirable that the cabinet latch assembly include certain universal mounting features so that the assembly may be adapted to cabinets of variant types.

One approach to the attachment of a lock assembly to a sheet metal cabinet door is by the use of a threaded shank on the assembly which is inserted from one side of the door through an aperture and a nut is thereupon affixed to the protruding shank at the opposite side of the door. With grounded electrical cabinets, a disadvantage of an assembly of this type is that, of necessity, the aperture must be slightly larger than the threaded shank and no electrical contact occurs. Even though a nut may be affixed, its smooth face which bears against the non-conductive surface coating, paint for example, is incapable of reliably piercing the coating to provide good electrical grounding.

Another approach to the attachment of latch assemblies is by screws inserted through holes other than the main aperture in which the assembly is received. The screw holes are located in such a way as to be in a register with threaded holes in the assembly and the screws are merely passed through the holes in the door and tightened to the assembly. This type of assembly suffers from some of the same deficiencies as that described above in that the aperture must necessarily be sized to provide some clearance for the inserted assembly. Similarly, the screw holes must be sized with a degree of clearance and the screws may not reliably pierce the non-conducting coating.

A latch assembly which would reliably pierce non-conducting coatings upon sheet metal doors and which also has universal mounting characteristics would be an important advance in the art.

OBJECTS OF THE INVENTION

It is an object of this invention to provide a latch assembly overcoming some of the problems and shortcomings of the prior art.

Another object of this invention is to provide a latch assembly capable of reliably piercing a non-conductive electrial coating on a sheet metal door so that electrical grounding of the assembly and its attached handle results.

Still another object of this invention is to provide a latch assembly which has certain universal mounting characteristics.

Yet another object of this invention is to provide a latch assembly which presents opportunities for reduced inventory costs because of its adaptability to a variety of cabinet types.

How these and other important objects are accomplished will be apparent from the descriptions of this invention which follow.

Summary of the Invention

A latch assembly includes a housing for inserting through an opening or breach in a door panel and secured to the panel by a retaining cage. In the preferred embodiment, the housing and the breach will have the same cross-sectional square shape. A retaining cage includes a retainer plate and a plurality of supporting legs and substantially surrounds the housing when the assembly is mounted on a door panel. At each cornering edge of the housing, a depression is formed for receiving a retainer extension formed at the end of each supporting leg. Each supporting leg also includes a support claw or tip which, in the mounted position, engages a surface of the door panel and pierces any non-conductive coating thereon so that the rotary bar handle and the other parts of the assembly may be electrically grounded.

The cooperative configuration of the housing and the retaining cage permits mounting of the assembly in one of four positions. The invention is especially useful in constructing cabinets for electrical equipment where such cabinets must be electrically grounded.

The objectives are realized, in keeping with the invention, in that the lock housing and the breach in the door leaf have the same cross-sectional shape, preferable square, that the retainer, in the form of a retaining cage with a retainer plate and supporting legs, encloses the lock housing has depressions matched to and aligned with the supporting legs of the retaining cage, that each supporting leg terminates in a retainer extension and a support claw, that the retainer extensions of the supporting legs project into the spaces left free between the lock housing and the breach, while the support claws of the supporting legs engage around the breach on the inside of the door leaf, and that the retaining cage is held on the lock housing by the rotary bar.

The lock can be very quickly and simply mounted, since the lock housing with the locking element need merely be inserted into the breach at the front. The retaining cage is then placed over the lock housing on the inside of the door leaf and the rotary bar is joined to the actuator of the locking element. The retainer extensions of the supporting legs then fix the retaining cage in place and the support claws penetrate the surface coating of the door leaf, so that electrical contact is established from the door leaf via the retaining cage to the rotary rod and the locking element.

When, in keeping with a special design, the depressions run along the cornering edges of the lock housing and receive the flat, correspondingly configured supporting legs of the retaining cage in two positions offset by 90°, the retaining cage can be placed over the lock housing in any desired position. This is especially advantageous when the design is such that the side of the retainer plate of the retaining cage remote from the lock housing is provided with stops for delimiting the rotary movement of the rotary bar. This makes it possible to adapt the end positions of the rotary bar to the type of jamb used for the door leaf. The end positions are determined by one stop working in conjunction with the long side of the rotary bar and another stop working in conjunction with a stud on the rotary bar, while the stops are located on two opposite sides of the retainer plate and are bent in the direction of the rotary bar. Electrical contact between the retaining cage and the door leaf is ensured by the fact that the support claws terminate in a tip or a sharp edge, while the retaining cage is made of an elastic or resilient metal.

Mounting the retainer cage on the lock housing is not impeded by the actuator of the locking element when the retainer plate is provided with a central breach for said actuator and is positioned against the side of the lock housing remote from the door leaf.

The nonrotary connection between the rotary bar and the actuator of the locking element is ensured by the fact that said actuator is formed as a cross-sectionally square receiver so that it cannot rotate.

One preferred embodiment is characterized by the fact that the locking element is designed as a locking cylinder and is secured on the outside of the door leaf by a lock plate. In the interest of further simplification, the lock plate and the lock housing are designed as a single element.

DETAILED DESCRIPTIONS OF PREFERRED EMBODIMENTS

Figures 1, 2, 3:
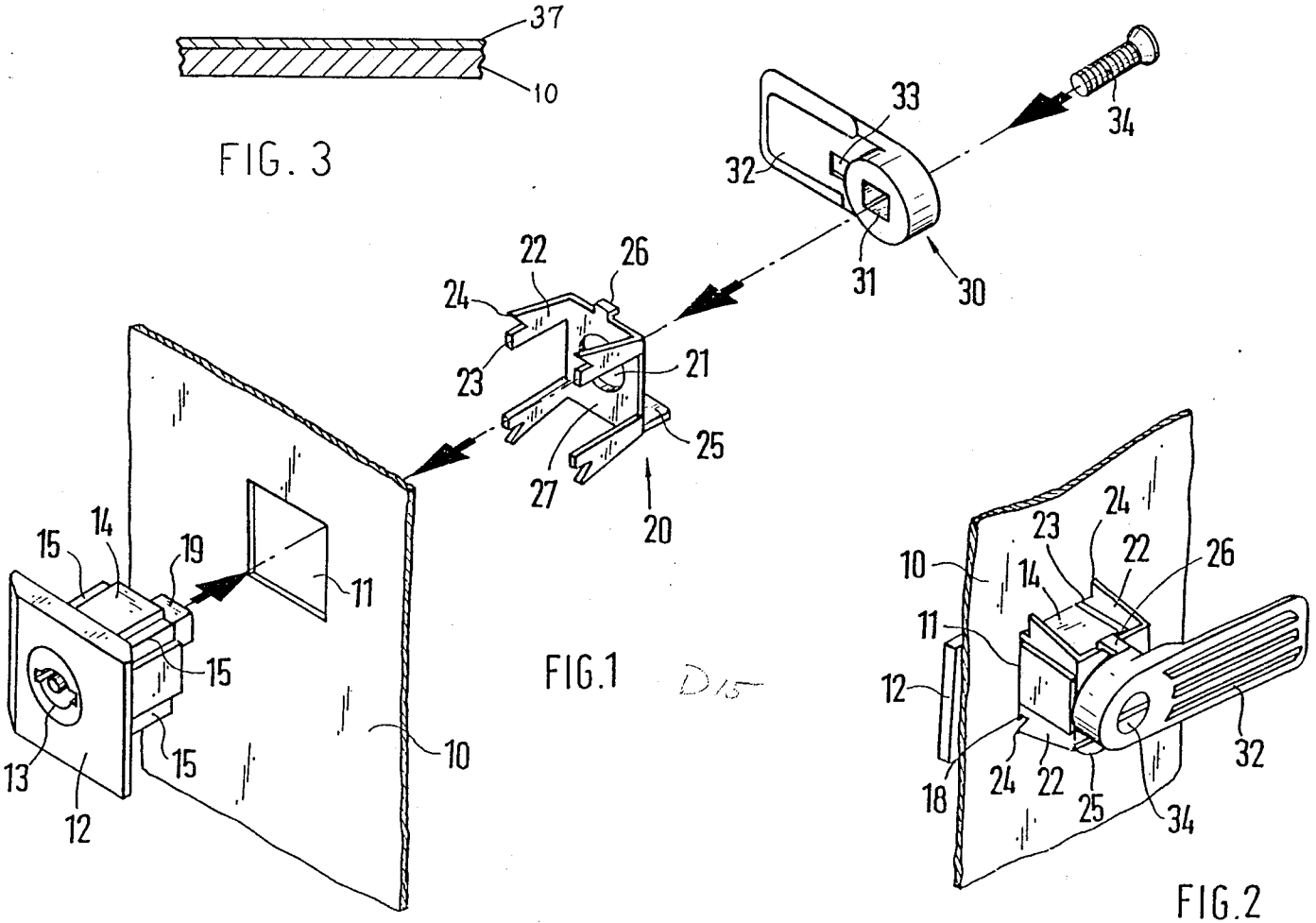
FIG. 1 is an exploded perspective view of the latch assembly shown in conjunction with a cabinet door panel.
FIG. 2 is a side perspective view of the latch assembly shown in a mounted, assembled position and viewed from the side of the cabinet door opposite that of FIG. 1.
FIG. 3 is a cross-sectional edge view, greatly enlarged, showing the panel with a paint or paint-like coating thereon.

In the illustrated embodiment of the latch assembly and referring to FIG. 1, the door panel or leaf 10 is provided with the square breach 11, into which the essentially square lock housing 14 is placed. Both the breach 11 and the lock housing 14 can, however, have other cross-sectional forms. The lock housing 14 is closed off by the lock plate 12 and receives a locking cylinder as the locking element 13, the actuator 19 of which projects rearwardly out of the lock housing 14. The cornering edges of the lock housing 14 are provided with depressions 15 which extend to the lock plate 12 and which define a square pattern. They thereby can receive a flat, four-cornered support leg 23 in either of two positions offset by 90° without exceeding the dimension delineated by the breach 11. Once the lock housing 14 has been positioned in the breach 11, the retaining cage 20 is placed as a retainer onto that part of the lock housing 14 protruding on the inside of the door panel 10. The retaining cage 20 has a retainer plate 27 with a central breach 21 for the actuator 19 of the locking element 19 which bears against the lock housing 14. At the four corners of the square retainer plate 27 are four canted supporting legs 22, which are all identically configured as shown in FIG. 1. Each supporting leg 22 terminates in a retainer extension 23 and a support claw 24, while the retainer extensions 23 are directed inward and the support claws 24 outward. The depressions 15 along the cornered sides of the lock housing 14 create free spaces 18 between the breach 11 and the lock housing 14, into which the retainer extensions 23 of the retaining cage 20 are inserted. As shown in FIG. 3, the inside surface of the door panel 10 has a coating 37 of nonconductive paint or a nonconductive, paint-like material. The support claws 24 lie outside the breach 11 and rest with their tips or sharp edges against the inside of the door panel 10, so that they penetrate an electrically nonconductive surface coating 37 to provide electrical contact with the door leaf 10, as the view in FIG. 2 clearly shows. When the breach 11 and the lock housing 14 are square, the lock can be installed in any one of four different positions. The same is true for the mounting of the retaining cage 20 on the lock housing 14. The retainer plate 27 has outward projecting stops 25, 26 on two opposite edges, which determine the end positions of the rotary bar 30. In the end position depicted in FIG. 2, the long side of the face 32 of the rotary bar 30 is in contact with the stop 25. When the rotary bar 30 is rotated upward by 90°, the stud 33 on the rotary bar 30 strikes the stop 26 on the retainer plate 27. Thus, the positioning of the retaining cage 20 on the lock housing 14 makes it possible t determine the limited positions of rotary travel of the rotary bar 30 that the flat, identically designed supporting legs 22 will also have sufficient room when the retaining cage 20 is placed onto the lock housing in any one of four positions 90° apart. The retainer extensions 23 will always come to rest in the free spaces formed in the corners of the breach 11 by the lock housing 14 with its depressions 15. The locking element 13 and the actuator 19 are also made of metal, so that they provide an electrically conductive connection via the rotary bar 30 and the retaining cage 20 with the door leaf 10. The lock plate 12 and the lock housing 14 can be made of metal or plastic. It is entirely possible that the lock plate 12 and the lock housing 14 can be designed and produced as a one-piece, injection-molded part.

While the principles of this invention have been described in connection with specific embodiments, it should be understood clearly that these descriptions are made only by way of example and are not intended to limit the scope of the invention.

I claim:

1. A cabinet latch assembly for electrically grounding a rotary bar attached to a cabinet having a non-conductive surface coating, the assembly including:

a housing;

a locking element received in said housing for rotary motion between a first latched position and a second open position, the locking element having a rotary bar coupled thereto;

a retaining cage for supporting said housing and said latching cylinder on a sheet metal door panel, said retaining cage including a retainer plate and a plurality of supporting legs defining a space therebetween, each of said supporting legs terminating in a retainer extension and a support claw, the housing being received in the space defined by the plate and the supporting legs;

said housing including depressions formed therein for receiving the supporting legs of said retaining cage;

said retainer extensions being received into said depressions in said housing and said support claws engaging the surface of said door panel when said latch assembly is mounted on said cabinet door, said claws piercing a non-conductive coating disposed thereon, the retaining cage and rotary bar thereby being electrically grounded to the door panel.

2. The latch assembly of claim 1 wherein the door panel has a thickness and wherein the length of said retainer extensions exceed that of the support claws by a dimension which is slightly less than the thickness of said door panel.

3. The latch assembly of claim 2 wherein said latch assembly includes an actuator protruding through a breach in said retaining plate and said retaining plate bears against said housing when said latching assembly is mounted on said cabinet door.

4. The latch assembly of claim 3 wherein each of said support claws includes a sharp projection for piercing a nonconductive coating on said door and said retaining cage is formed of metal to a thickness permitting resilient movement of said retainer plate when said retaining cage is secured to said housing by the attachment of said rotary bar.

5. The latch assembly of claim 1 wherein said depressions are formed in the cornering edges of said housing for receiving said supporting legs in either of two positions, said positions being offset from one another by 90°.

6. The latch assembly of claim 2 wherein said depressions are formed in the cornering edges of said housing for receiving said supporting legs in either of two positions, said positions being offset from one another by 90°.

7. The latch assembly of claim 3 wherein said depressions are formed in the cornering edges of said housing for receiving said supporting legs in either of two positions, said positions being offset from one another by 90°.

8. The latch assembly of claim 5 wherein said depressions are formed in the cornering edges of said housing for receiving said supporting legs in either of two positions, said positions being offset from one another by 90°.

9. A latch assembly for maintaining a cabinet door in a locked position including:

a lock housing to be received through a breach in said cabinet door, said lock housing having a rotatable locking element confined therewithin;

a retaining cage for securing said housing to said cabinet door, said cage including a retainer plate and a plurality of support legs, said plate and said legs coacting to substantially surround said housing when said housing is mounted;

said support legs being received in depressions formed in said housing when said housing is mounted, said legs having a claw for piercing a nonconductive coating on said door; and thereby grounding the latch assembly to the door said locking element including an actuator protruding through said retainer plate, said assembly including a rotary bar for attachment in driving engagement to said actuator when said housing is mounted;

said retainer plate including a pair of stops for limiting the travel of said bar when said assembly is actuated.

10. The assembly of claim 9 wherein said rotary bar includes a stud for engaging one of said stops, the rotation travel of said bar being limited in one direction by the engagement of said stud and one of said stops and in the other direction by the engagement of the other of said stops with a long edge of said rotary bar.

11. The assembly of claim 10 wherein said retaining plate is substantially square and said stops project from opposite edges of said plate in a direction toward said rotary bar when said assembly is mounted.

12. The assembly of claim 9 wherein said locking element includes a locking cylinder rotatable within said housing and a lock plate attached to said cylinder and rotatable therewith for locking said door in a closed position when said bar is rotated.

13. The assembly of claim 10 wherein said locking element includes a locking cylinder rotatable within said housing and a lock plate attached to said cylinder and rotatable therewith for locking said door in a closed position when said bar is rotated.

14. The assembly of claim 11 wherein said locking element includes a locking cylinder rotatable within said housing and a lock plate attached to said cylinder and rotatable therewith for locking said door in a closed position when said bar is rotated.

15. The assembly of claim 9 wherein said assembly is inserted into said door along an axis and wherein said housing includes a plurality of depressions, each formed in a cornering edge of said housing, said supporting legs thereby being received in said depressions in positions offset by 90° one from the other, said assembly thereby being mountable in a cabinet door in any of four mounting positions.

16. The assembly of claim 10 wherein said assembly is inserted into said door along an axis and wherein said housing includes a plurality of depressions, each formed in a cornering edge of said housing, said supporting legs thereby being received in said depressions in positions offset by 90° one from the other, said assembly thereby being mountable in a cabinet door in any of four mounting positions.

17. The assembly of claim 11 wherein said assembly is inserted into said door along an axis and wherein said housing includes a plurality of depressions, each formed in a cornering edge of said housing, said supporting legs thereby being received in said depressions in positions offset by 90° one from the other, said assembly thereby being mountable in a cabinet door in any of four mounting positions.

18. The assembly of claim 12 wherein said assembly is inserted into said door along an axis and wherein said housing includes a plurality of depressions, each formed in a cornering edge of said housing, said supporting legs thereby being received in said depressions in positions offset by 90° one from the other, said assembly thereby mountable in a cabinet door in any of four mounting positions.

19. The assembly of claim 13 wherein said assembly is inserted into said door along an axis and wherein said housing includes a plurality of depressions, each formed in a cornering edge of said housing, said supporting legs thereby being received in said depressions in positions offset by 90° one from the other, said assembly thereby being mountable in a cabinet door in any of four mounting positions.

20. The assembly of claim 14 wherein said assembly is inserted into said door along an axis and wherein said housing includes a plurality of depressions, each formed in a cornering edge of said housing, said supporting legs thereby being received in said depressions in positions offset by 90° one from the other, said assembly thereby being mountable in a cabinet door in any of four mounting positions.

* * * * *

UNITED STATES PATENT AND TRADEMARK OFFICE

CERTIFICATE OF CORRECTION

PATENT NO. : 4,951,980

DATED : August 28, 1990

INVENTOR(S) : Manfred Wetzel

It is certified that error appears in the above-identified patent and that said Letters Patent is hereby corrected as shown below:

In Column 3, Line 2, delete "jamb" and insert --jam--.

In Column 3, Line 62, delete "19" and insert --13--.

In Column 4, Line 24, change "t determine" to --to determine--.

In Column 5, Line 43, delete "to be".

In Column 5, Line 61, delete "assembly" and insert --housing--.

Signed and Sealed this

Twenty-eighth Day of January, 1992

*Attest:*

HARRY F. MANBECK, JR.

*Attesting Officer*

*Commissioner of Patents and Trademarks*